US005844211A

United States Patent [19]

Henry et al.

[11] Patent Number: 5,844,211

[45] Date of Patent: Dec. 1, 1998

[54] CONTOURED HEATING ELEMENT

[75] Inventors: Sam W. Henry, Ogden; Myron Jensen, Harrisville, both of Utah

[73] Assignee: Emerson Electric Co., St. Louis, Mo.

[21] Appl. No.: 837,005

[22] Filed: Apr. 11, 1997

[51] Int. Cl.[6] ..... H05B 3/06

[52] U.S. Cl. ..... 219/523; 219/386; 392/498; 392/503

[58] Field of Search ..... 392/498, 500, 392/503; 219/523, 385–387

[56] References Cited

U.S. PATENT DOCUMENTS

| | | | |
|---|---|---|---|
| 3,148,268 | 9/1964 | Heinbuch | 392/500 |
| 3,619,565 | 11/1971 | D'Elia et al. . | |
| 3,666,003 | 5/1972 | Clark, Jr. et al. . | |
| 3,674,985 | 7/1972 | Ragault . | |
| 4,105,895 | 8/1978 | Kennedy | 219/523 |
| 4,319,127 | 3/1982 | Lindstrom | 219/523 |
| 4,687,905 | 8/1987 | Cunningham et al. . | |
| 5,013,890 | 5/1991 | Gamble . | |
| 5,187,772 | 2/1993 | Rumbley | 392/500 |
| 5,459,812 | 10/1995 | Taylor | 219/523 |

*Primary Examiner*—Teresa J. Walberg
*Assistant Examiner*—Quan Nguyen
*Attorney, Agent, or Firm*—Polster, Lieder, Woodruff & Lucchesi

[57] ABSTRACT

The present invention relates to an electric immersion heater utilized in heating liquids contained in a cylindrical container, such as a boiler. The immersion heater is affixed to the side of the container with the heater elements extending through the side of the container through an access hole. The heater elements are contoured so as to allow more than one heater to be installed at a given level through the side of the container.

8 Claims, 2 Drawing Sheets

CONTOURED HEATING ELEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a heating element of an electric immersion heater utilized most commonly in a boiler.

In many industrial applications, hot water is required for processes and for heating air or other substances. Large boilers are manufactured to heat large quantities of water, or one or a series of small boilers may be used. The demand for hot water may be large, small, intermittent or continuous. It is more economical to use a small boiler than a large one for continuous hot water demand from a standpoint of space and cost. However, heating must be rapid and all regions of the boiler should be heated at the same time. Thus it may be found to be desirable to use a multiplicity of heaters, i.e., heating elements generally of the immersion type, so as to simultaneously heat water in all portions of the boiler.

One of the most efficient ways to heat water in a closed cylindrical container, such as a boiler, is by use of an electric immersion heater. The immersion heater is mounted on the side of the boiler. The heater elements extend through the side of the boiler and hence, are immersed in the water in the boiler. In order for the heater to be attached to the side of the boiler, most generally the immersion heater has a flange which is affixed to an access hole or a nozzle on the side of the boiler. One particularly suitable nozzle is a flanged nozzle with an integral backing ring for saddle on welding, and is welded in place so that no bolt holes in the side of the boiler are required. Any satisfactory nozzle or access hole may be used for attachment of the immersion heater.

More than one immersion heater frequently is needed in each boiler. Generally up to six or more immersion heaters are used in each boiler. The heating elements of the immersion heaters generally extend almost the entire diameter of the boiler so as to provide maximum surface area for contact with the water. Because the boiler is cylindrical, and the heater elements are straight, the placing of more than one heater at a given level on the side of the boiler may cause the heating elements to intersect one another and make it is necessary to place the heaters at different levels. This requirement creates limitations on the number of immersion heaters which can be mounted through the side of a boiler. Furthermore, when welding the heater to the side of the boiler, difficulty is encountered because frequently the heater has to be placed at an angle to accommodate the straight heater elements necessitating welding at obtuse angles.

The present invention provides an immersion heater having contoured heating elements so that more than one immersion heater can be placed at a given level on the side of a boiler and the heater when placed on the side of the boiler is more easily positioned.

BRIEF SUMMARY OF THE INVENTION

The present invention provides an electric immersion heater adapted to be mounted on the wall of a cylindrical container with an active heating portion extending through an opening in the wall of the container for heating the contents of the container, the immersion heater comprising a flange adapted to mate with an access hole, heating elements extending through the flange having wiring ends on one side of the flange and the major portion of the heating elements on the other side of the flange, the heating elements being parallel to one another and preferably, each being U-shaped, the heating elements further being contoured by having a bend such that the elements from each heater do not intersect elements from another heater when being mounted on the cylindrical container at substantially the same level. The angle of the bend placed in the heater elements is from about 140° to about 165°. The angle of the bend in each of the heater elements in one heater are the same so that the heater elements remain parallel to each other. The bend in the heater elements of one heater are the mirror image of the bend in the elements of another heater installed on the same level. Most generally a bend of about 150° at a point before intersection of the heating elements with one another most usually will prevent intersection provided that the heaters are installed relatively close to one another on the same level.

DETAILED DESCRIPTION OF THE INVENTION

Figure 1:
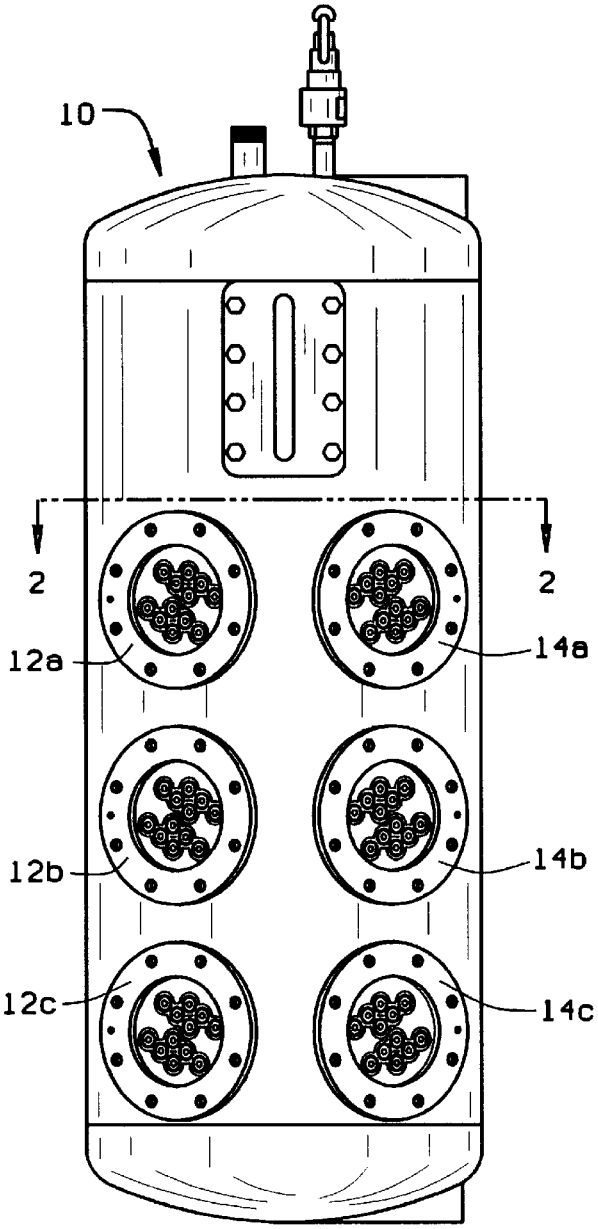
FIG. 1 is a perspective view of a cylindrical container.

Corresponding reference numerals will be used throughout the several figures of the drawings.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 2:
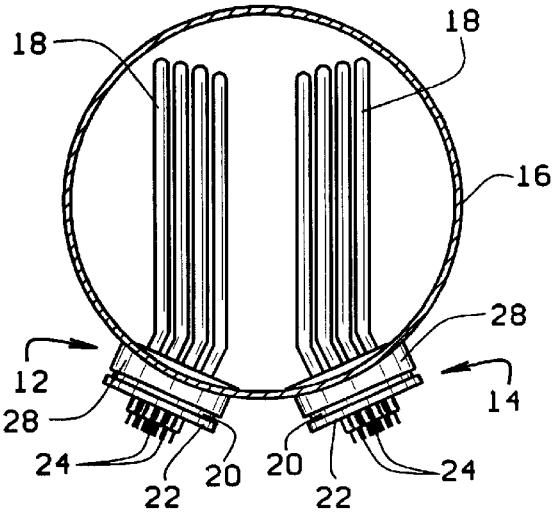
FIG. 2 is a top view taken along the line 2—2 of FIG. 1.

FIG. 1 depicts a cylindrical boiler 10 having immersion heaters 12*a*, 12*b*, 12*c*, 14*a*, 14*b*, and 14*c* installed on the side 16 of the boiler 10. In FIG. 2, a top view taken along line 2—2 of FIG. 1, reveals the immersion heaters 12 and 14. The immersion heater 14 is installed through the side 16 of the boiler 10 by fastening the heater flange 22 to the access hole or in this case a nozzle 28 with a sealing gasket 20 in between the flange of the nozzle 28 and the heater flange 22. When installing the immersion heater 14 the heater elements 18 are fed through the nozzle 28 and seated within the boiler as shown. Likewise, the immersion heater 12 is installed in a similar manner. The heater elements of the immersion heaters 12 and 14 are seated in relation to each other such that the heater elements 18 of the heater 12 are substantially parallel to the heater elements 18 of the heater 14. This is made possible by the contour of the heater elements 18. The angle 15 (see FIG. 3) of the bend placed in the heater elements 18 is about 150° for most boilers, however it might be preferred in a small boiler having a diameter of less than about 50 inches that the angle 15 of contour be about 140°.

Figure 3:
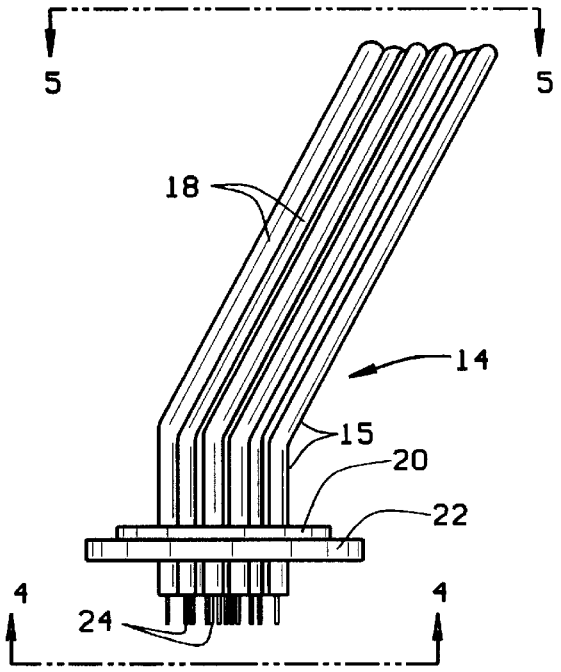
FIG. 3 is an enlarged view of heating element 14 of FIG. 1.

FIG. 3 is an enlarged view of the immersion heater 14 of FIG. 2. The heater elements 18 are contoured at approximately 150° with the angle or bend 15 being placed at about 20% of the length of the elements 18 from the flange 22. Typically it is necessary that the bend 15 in the elements 18 should be placed at a point less than about 40% of the distance along the length of the elements 18 from the flange 22. The wiring ends 24 of the heater elements 18 are conventionally wired on the exterior of the boiler 10 to a suitable power source.

Figure 4:
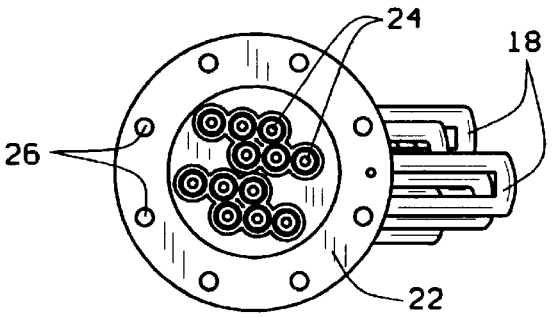
FIG. 4 is an end view along line 4—4 of FIG. 3.

FIG. 4 is an end view along line 4—4 of FIG. 3 illustrating the flange 22 containing the bolt holes 26 for fastening the flange 22 to the nozzle 28. It should be noted that the immersion heaters 14*a*, 14*b*, and 14*c* installed in the boiler 10 are the same as the end view of FIG. 4.

Figure 5:
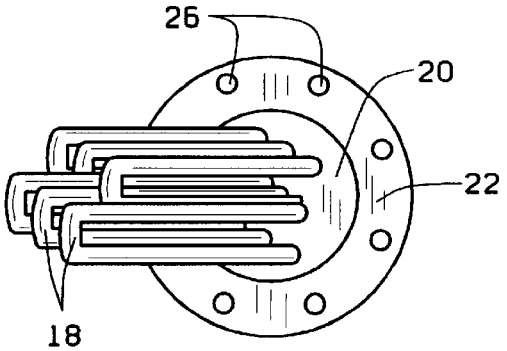
FIG. 5 is an end view along line 5—5 of FIG. 3.

FIG. 5 is an end view taken along line 5—5 of FIG. 3 depicting the elements 18 in a view where the U-shape of each element is apparent. Although the immersion heaters depicted here have six heater elements, any number of heater elements can be used and can be contoured in accordance with the present invention.

If the angle of the contour of the heater elements of two heaters installed as discussed above approaches 140° a third immersion heater without contoured elements can be installed immediately opposite the mid point between the heaters with contoured elements at the same level in the cylindrical container. The contoured elements of the two heaters may have to be shortened slightly as the angle of the contour approaches 140° in order to avoid contact with the inside of the cylindrical container.

Since the horizontal cross-section of the cylindrical container is a circle having 360°, the placement of two heaters having contoured elements is limited. For instance, if the two heaters are placed immediately adjacent one another, then one heater can be moved about 25° apart from the other on the circumference of the cylindrical container when the elements of each heater are contoured at an angle of about 150°.

In a typical example, a boiler, with an inside diameter of 18 inches, a height of about 4 feet and a capacity of about 40 gallons, has six heaters affixed through the side of the boiler as described above with two heaters at each of three levels. Each of the heaters is about 15 in. in length with heater elements which extend about 13 to 14 inches into the boiler. The contour on each heater element commences about 2 to 3 inches from the flange. The approximate angle (15) is about 150°. Because the heaters are substantially identical, three of the heaters are rotated 180° from the other three to allow installation of two heaters at each of three levels without contact of one heater's elements with the elements of another heater.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. An electric immersion heater adapted to be mounted through a wall of a cylindrical container and having an active heating portion extending through an access hole in the wall of the container for heating the contents of the container, the immersion heater comprising a flange adapted to mate with the access hole in the side of the container, and heating elements extending through the flange of the immersion heater having wiring ends on one side of the flange and the major portion of the heating elements on the other side of the flange of the immersion heater, the heating elements being parallel to one another and being contoured by having a bend with an angle from about 140° to about 165°.

2. The heater of claim 1 wherein the bend in the heating elements is about 150° and the bend is located at a position less than 40% of the length of the heating elements from the heater flange.

3. The heater of claim 2 wherein the bend in the heating elements is located at a position at about 20% of the length of the heating elements from the heater flange.

4. The heater of claim 1 wherein the heating elements are each U-shaped.

5. A cylindrical container suitable for containing liquids, having mounted on a wall thereof at substantially the same level, at least two electric immersion heaters each with an active heating portion extending through an access hole in the wall of the container for heating the contents of the container, each immersion heater comprising a flange adapted to mate with an access hole in the wall of the container, and heating elements extending through the flange of the immersion heater having wiring ends on one side of the flange and the major portion of the heating elements on the other side of the flange of the immersion heater, the heating elements being parallel to one another and being contoured by having a bend with an angle from about 140° to about 165° such that when each electric immersion heater is mounted on the wall of the cylindrical container at substantially the same level, the elements from each heater do not intersect the elements of another heater.

6. The container of claim 5 wherein the heating elements of one heater are substantially parallel to the heater elements of another heater when the two heaters are installed on the wall of the container at the same level.

7. The container of claim 5 wherein the container is a boiler containing a liquid.

8. The container of claim 5 wherein the liquid is water.

* * * * *